552846 0750 400 10-11-83 29193 09-08-83 164505 78147.0 04409117 2518

United States Patent [19]

Holmberg et al.

[11] 4,409,117

[45] Oct. 11, 1983

[54] DETERGENT COMPOSITIONS STABLE TO CHLORINE SEPARATION, AND AGENTS FOR PRODUCING SAME

[75] Inventors: Krister Holmberg, Mölndal; Ingvar Nilsson, Kungälv, both of Sweden

[73] Assignee: EKA AB, Surte, Sweden

[21] Appl. No.: 217,527

[22] Filed: Dec. 17, 1980

[51] Int. Cl.[3] ..... C11D 3/395; C11D 7/26; C11D 7/56; C11D 17/06

[52] U.S. Cl. ..... 252/99; 252/102; 252/174.13; 252/186.35; 427/212; 427/220

[58] Field of Search ..... 252/91, 95, 99, 174.13, 252/187 C, 186.35, 187.34; 427/212, 220

[56] References Cited

U.S. PATENT DOCUMENTS

| | | | |
|---|---|---|---|
| 3,838,072 | 9/1974 | Smith | 252/540 |
| 3,847,830 | 12/1974 | Williams | 252/186 |
| 3,868,336 | 2/1975 | Mazzola | 252/527 |
| 3,979,318 | 9/1976 | Tokiwa | 252/186 |
| 4,126,717 | 11/1978 | Mazzola | 427/220 |

*Primary Examiner*—Dennis L. Albrecht
*Attorney, Agent, or Firm*—Luedeka & Neely

[57] ABSTRACT

Detergent compositions stable to chlorine separation are described, which as main constituents contain alkali metal phosphate, alkali metal silicate, a surfactant and granulate chlorinated triazine trione, the granules of the chlorinated triazine trione being coated with a thin layer of a hydrophobic substance. The surface-treated chlorinated triazine trione which constitutes an agent for producing the composition, is also described as is the use of the composition as a machine dish washing detergent or industrial detergent.

8 Claims, No Drawings

DETERGENT COMPOSITIONS STABLE TO CHLORINE SEPARATION, AND AGENTS FOR PRODUCING SAME

This invention relates to detergent compositions stable to chlorine separation for use as machine dish washing detergents or industrial detergents, and to agents for producing said compositions.

Machine dish washing detergent compositions for example consist mainly of
alkali metal phosphate
alkali metal silicate
surfactant
organic chlorine compound.

The alkali metal phosphate, usually sodium tripolyphosphate, primarily serves as complexing agent for calcium and magnesium ions.

The alkali metal silicate normally is a sodium silicate having a molar ratio $SiO_2$:$Na_2O$ of 3.50 to 0.75. Usually, use is made of so-called sodium metasilicate, which implies that said ratio lies about 1. The purpose of the silicate is to provide a high pH, which is needed int.al. for hydrolysis of edible fat rests, and to have a corrosion preventing effect.

The sodium metasilicate may be either practically anhydrous or be present as a hydrate with crystal bound water. The commercially most usual hydrate is the crystal form called pentahydrate. This product is usually written as $SiO_2.Na_2O.5H_2O$, but actually is a tetrahydrate of the salt $Na_2H_2SiO_4$. This crystal form is hereinafter called "pentahydrate".

The pentahydrate offers several advantages over the anhydrous sodium metasilicate in machine dish washing detergent compositions, int.al. because it is more readily soluble and considerably cheaper. The introduction of water into a machine dish washing detergent composition in powder form, however, as experience has shown, entails problems regarding the stability of the organic chlorine compounds. These readily hydrolyzed compounds in fact give off chlorine gas in a moist environment, which amounts to a considerable technical problem. For these reasons, use is preferably made of anhydrous sodium metasilicate in said products.

The surfactant usually is a low-foaming non-ionic surfactant, preferably a block polymer of ethylene and propylene oxide. Its task is to contribute to wetting and emulisification simultaneously as it shall have an antifoaming effect on for example proteins.

The organic chlorine compound or chlorine carrier functions as an oxidative bleaching agent which has the task of attacking deposits of int.al. coffee, tea and fruit juices. The economically most favourable chlorine carrier is trichloroisocyanuric acid, but it is very instable and gives off chlorine too easily to permit being used in practice. Salts of dichloroisocyanuric acid are therefore used in most cases and the sodium salt has, primarily for economical reasons, been most widely utilized.

Apart from the above-mentioned main components, machine dish washing detergents often also contain varying quantities of alkali metal carbonates and bicarbonates, corrosion inhibitors, dyes and perfume.

What has been said above about machine dish washing detergents is also true, in applicable parts, to industrial detergent compositions generally.

There have been made great efforts to stabilize the organic chlorine compounds in detergent compositions and thereby to reduce the problem of a premature chlorine gas development. It has been tried, by addition of reducing agents (cf. German Pat. No. 1,111,198) or by adjustment of pH with the aid of a combination of boron oxide and soda (cf. French Pat. No. 1,537,311) to reduce the tendency of chlorine separation in alkali salts of dichloroisocyanuric acid. There is also described a method of adding paraffin oil to compositions based on these chlorine compounds (cf. U.S. Pat. No. 3,390,092). Trichloroisocyanuric acid also has been stabilized for instance by means of an olefin having a carbon-carbon double bond, one carbon atom of said double bond being tertiary (cf. British Pat. No. 848,397). Common to all of these methods is that even though they imply a certain improvement as to stability to chlorine separation, the result is far from satisfactory. With the use of sodium metasilicate pentahydrate in detergents an uncontrolled discharge of chlorine gas therefore still is a production-technical problem for the industries producing the detergents and also an important practical problem for the consumer because of chlorine smell and lower bleaching effects.

It has now been found that the tendency of chlorine separation in organic chlorine compounds can be reduced and a surprisingly good result be reached by surface-treating said chlorine compounds in granular form with a hydrophobic substance. However, a prerequisite is that the chlorine compounds are present in granulated form, with a particle size of about 0.5 to 5 mm. Pulverulent compounds cannot be surface-treated in this way since caking of the product will result from such a treatment. Machine dish washing detergents and industrial detergents based on surface-treated organic chlorine compounds show a high degree of stability of chlorine separation. Surface-treated trichloroisocyanuric acid also gives acceptable results when used in machine dish washing detergents and industrial detergents.

A considerable reduction of the chlorine losses is obtained not only at the storing of the finished machine dish washing detergent but also in the production thereof when use is made of a chlorine compound surface-treated in accordance with the present invention.

This invention thus relates to a detergent composition comprising alkali metal phosphate, alkali metal silicate, a surfactant, a chlorinated triazine trione of formula (I)

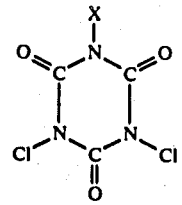

(I)

wherein X is Cl, Na or K, or when X is Na, the dihydrate thereof, and optionally conventional additives. Said composition is characterized in that the chlorinated triazine trione of formula (I) is in the form of granules coated with a thin hydrophobic layer of a diester of phthalic acid or adipinic acid with an alcohol having 4–18 carbon atoms in an amount of 3–9% by weight, calculated on the amount of chlorinated triazine trione of formula (I).

The invention further relates to an agent for producing the detergent composition, said agent being characterized in that it consists of granules of chlorinated triazine trione of formula (I)

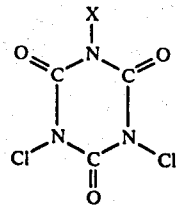

(I)

wherein X, is CL, Na or K, or the dihydrate of the triazine trione of formula (I) when X is Na, said granules being coated with a thin hydrophobic layer of a diester of phthalic acid or adipinic acid with an alcohol having 4–18 carbon atoms in an amount of 3–9% by weight, calculated on the amount of the chlorinated triazine trione of formula (I).

Different embodiments of the composition according to the invention comprise a machine dish washing detergent composition and an industrial detergent composition, respectively.

The surface-treatment of the chlorinated triazine trione is preferably performed such that the hydrophobic substance in liquid form or dissolved in a readily volatile solvent is added by portions under some kind of agitation to the granulate chlorinated triazine trione which is thereby coated with a thin film of hydrophobic material effectively protecting the labile chlorine compound from contact with water.

The hydrophobic film-forming substances utilized in the surface-treatment are diesters of certain carboxylic acids, particularly phthalic acid or adipinic acid, which surprisingly have proved to yield excellent results.

The diesters preferably utilized in the invention are diesters of phthalic acid or adipinic acid with an alcohol having 4–18 carbon atoms, preferably a straight or branched alcohol having 6–12 carbon atoms. The following diesters have proved to be particularly useful:

phthalate 610*
di-(2-ethyl hexyl)phthalate
diisodecyl phthalate
di-(2-ethyl hexyl)adipate
diisodecyl adipate

*phthalate 610 is the trade name of a fraction of diesters of phthalic acid and alcohols having 6–10 carbon atoms.

The most important physical property required in the diesters utilized for the surface-treatment is that they shall be sufficiently water-repellent in order that also a thin layer of the diester shall provide a fully satisfactory moisture protection for the enclosed chlorine compound. Further, it is advantageous if the diester is liquid at room temperature or has a melting point not too far above said temperature, preferably below 70° C. Use can also be made of diesters having a higher melting point, in which case these are first dissolved in a volatile solvent whereupon the surface-treatment proper is performed and the solvent is finally driven off by heating of the granulate surface-treated product.

Naturally, it is also of great importance for the diesters to have a good adhesion to the granulate chlorine compound.

The chlorinated triazine compounds of formula I comprise

Na-dichloroisocyanurate
Na-dichlorisocyanurate dihydrate
K-dichloroisocyanurate
trichloroisocyanuric acid.

A complex between K-dichlorocyanurate and trichloroisocyanuric acid is also well suited for use with the present invention.

The surface-treatment provides an effect already at astonishingly small amonts of the hydrophobic substance. For most of the substances tested a content of 3–9% by weight calculated on the chlorinated triazine trione has proved to be sufficient. In most cases it has even been found disadvantageous to exceed that amount as this results in the surface-treated product becoming sticky and having a tendency of aggregating.

A machine dish washing detergent composition being an embodiment of the present invention has the following constitution as regards its essential components (the percentages are percentages by weight):

alkali metal phosphate in an amount of 25–60%, preferably 40–50%, alkalimetal silicate in an amount of 30–70%, preferably 40–60%, molar ratio $SiO_2$:$Na_2O$ ($K_2O$) of 3.50–0.75, preferably about 1, and a water content of 0–60%, preferably 0–5% or 35–45%, a low foaming non-ionic type surfactant in an amount of 0.5–3%, preferably 1–2%, a chlorinated triazine trione of formula (I), surface-treated with a hydrophobic substance in an amount of 1–5%, preferably 1–3% (the amount of hydrophobic substance is 3–9%, preferably 5–8%, calculated on the chlorinated triazine trione), conventional additives in an amount of 0–40%, preferably 0–20%.

An industrial detergent composition being another embodiment of the present invention has the following constitution (the percentages are percentages by weight):

alkali metal phosphate in an amount of 25–60%, preferably 40–50%, alkali metal silicate in an amount of 20–70%, preferably 25–45%, molar ratio $SiO_2$: $Na_2O$($K_2O$) of 3.50–0.75, preferably about 1, and a water content of 0–60%, preferably 0–5% or 35–45%, alkali metal hydroxide in an amount of 0–30%, preferably 10–20%, a low foaming non-ionic type surfactant in an amount of 0.5–3%, preferably 1–2%, a chlorinated triazine trione of formula (I), surface-treated with a hydrophobic substance, in an amount of 1–10%, preferably 2–5% (the amount of hydrophobic substance is 3–9%, preferably 5–8%, calculated on the chlorinated triazine trione), conventional additives in an amount of 0–40%, preferably 0–20%.

As will appear from Example 3 below, it is possible to produce with the aid of the above-described surface-treating method a detergent composition based on sodium metasilicate pentahydrate which is at least equally stable to chlorine separation as a corresponding product based on anhydrous sodium metasilicate and a non-treated organic chlorine compound. The amount stated of hydrophobic material for the surface treatment, usually 5–8% of the amount of organic chlorine compound, usually constitutes but 0.05–0.25% of the total detergent composition. The additional cost of said raw product and of the extra operation the surface treatment involves, is small compared with the savings in raw material costs realized by turning from anhydrous metasilicate to the pentahydrate thereof.

Especially astonishing is that very good results are also obtained with trichloroisocyanuric acid (see Example 2).

Another advantage gained by the surface-treating method indicated thus resides in the possibility of being able to replace the anhydrous metasilicate in detergents with the corresponding pentahydrate, retaining the stability to chlorine separation of the detergents. An alternative application of the surface-treating method is to provide compositions based on anhydrous metasilicate and a surface-treated organic chlorine compound, said compositions being extremely stable to chlorine separation. However, such a formulation will be relatively expensive and may probably be used only for special purposes.

The following Examples are meant to illustrate the invention without restricting it in any way.

EXAMPLE 1

The effect of a surface-treatment of Na-dichloroisocyanurate for machine dish washing detergents stored at 30° C./85% relative moisture was examined. The samples were stored in board cartons treated with polyethylene. The chlorine content was determined by titration according to the iodine-thiosulphate method.

The following machine dish washing detergent composition was used in the tests:

| | |
|---|---|
| sodium tripolyphosphate | 40.0 parts |
| sodium metasilicate pentahydrate | 50.0 parts |
| non-ionic surfactant (block polymer of ethylene and propylene oxide) | 2.0 parts |
| surface-treated sodium dichloroisocyanate | 2.0 parts |
| water | 6.0 parts |

A great many different substances were tested as surface-treating agents. The substances most useful in practice are indicated in Table 1.

The surface-treating agent was added by portions under vigorous agitation to the granulate chlorine compound. After finished addition the agitation was continued for a further 2–3 minutes. Low viscous substances were added at room temperature whereas high viscous substances as well as solid compounds were first heated to suitable viscosity. The surface treating agent was added in an amount of 7%, and in some cases also 5%, calculated on the chlorine compound. A reference test was made, in which the surface-treating agent was replaced by soda which is totally inert in this connection.

The chlorine content of the various dish washing detergent compositions which thus differ only with regard to the surface-treatment of sodium dichloroisocyanurate, was determined as a function of the storage time.

The results of the test are given in Table 1.

TABLE 1

| | Residual chlorine (in %) | | | |
|---|---|---|---|---|
| | Storage time (months) | | | |
| Surface-treating agent | 0 | 1 | 2 | 4 |
| Phthalate 610* (7%) | 1.13 | 1.03 | 0.88 | 0.80 |
| Di-(2-ethyl hexyl)phthalate (7%) | 1.16 | 0.94 | 0.92 | 0.90 |
| Diisodecyl phthalate (7%) | 1.11 | 0.92 | 0.89 | 0.87 |
| Di-(2-ethyl hexyl)adipate (7%) | 1.11 | 0.91 | 0.83 | 0.78 |
| Diisodecyl adipate (7%) | 1.10 | 0.95 | 0.84 | 0.80 |
| Di-(2-ethyl hexyl)phthalate (5%) | 1.12 | 0.88 | 0.84 | 0.82 |

TABLE 1-continued

| | Residual chlorine (in %) | | | |
|---|---|---|---|---|
| | Storage time (months) | | | |
| Surface-treating agent | 0 | 1 | 2 | 4 |
| Reference test (7% soda) | 1.15 | 0.86 | 0.72 | 0.48 |

*Phthalate 610 is the trade name of a fraction of diesters of phthalic acid with alcohol having 6–10 carbon atoms.

EXAMPLE 2

The effect of a surface-treatment of trichloroisocyanuric acid for machine dish washing detergents stored at 30°/85% relative moisture was examined. The samples were stored in board cartons treated with polyethylene. The chlorine content was determined by titration according to the iodine-thiosulphate method.

The following machine dish washing detergent composition was used in the tests:

| | |
|---|---|
| sodium tripolyphosphate | 40.6 parts |
| sodium metasilicate pentahydrate | 50.0 parts |
| non-ionic surfactant | 2.0 parts |
| surface-treated trichloroisocyanuric acid | 1.4 parts |
| water | 6.0 parts |

A great many different substances were tested as surface-treating agents. The substances most useful in practice are indicated in Table 2.

The surface-treating agent was added by portions under vigorous agitation to the granulate chlorine compound. After finished addition agitation was continued for a further 2–3 minutes. Low viscous substances were hereby added at room temperature whereas high viscous substances as well as solid compounds were first heated to a suitable viscosity. The surface-treating agent was added in an amount of 6%, calculated on the chlorine compound. A reference test was made in which the surface-treating agent had been replaced by soda which is entirely inert in this connection.

The chlorine content of the different machine dish washing detergent compositions which thus differ only with regard to the surface-treatment of trichloroisocyanuric acid, was determined as a function of the storage time.

The results of the tests are indicated in Table 2.

TABLE 2

| | Residual chlorine (in %) | | | |
|---|---|---|---|---|
| | Storage time (months) | | | |
| Surface treating agent | 0 | 1 | 2 | 4 |
| Di-(2-ethyl hexyl)phthalate | 1.32 | 0.87 | 0.69 | 0.64 |
| Diisodecyl adipate | 1.28 | 0.85 | 0.66 | 0.61 |
| Reference test (soda) | 0.78* | 0.30 | 0.18 | 0.11 |

*The low 0-value is due to chlorine losses in the production of the machine dish washing detergent.

EXAMPLE 3

The effect of the surface-treatment of the organic chlorine compound for machine dish washing detergents based on anhydrous metasilicate and the pentahydrate thereof, respectively, was tested and compared with regard to stability to chlorine separation. Use was made as surface-treating agent of di-(2-ethyl hexyl)phthalate in an amount of 7% calculated on the organic chlorine compound. The following formulations were used:

| | A | B |
|---|---|---|
| sodium tripolyphosphate | 40.0 parts | 40.0 parts |
| sodium metasilicate, anhydrous | — | 40.0 parts |
| sodium metasilicate, pentahydrate | 50.0 parts | — |
| non-ionic surfactant (block polymer of ethylene and propylene oxide) | 2.0 parts | 2.0 parts |
| surface-treated sodium dichloroisocyanurate | 2.0 parts | 2.0 parts |
| water | 6.0 parts | 10.0 parts |
| soda | — | 6.0 parts |

Reference tests were made for the two formulations (reference A and reference B, respectively), in which the di-(2-ethyl hexyl)phthalate was replaced by soda. The procedure applied at the surface-treatment like the execution and evaluation of the tests were analogous with those in Example 1.

The results of the examination will appear from Table 3. As is evident, the surface treatment had a positive effect in both cases. It also appears from the Table that a machine dish washing detergent based on metasilicate pentahydrate and surface-treated chlorine compound (A) will be at least equally stable to chlorine separation as a detergent based on anhydrous metasilicate and untreated chlorine compound (B).

TABLE 3

| | Residual chlorine (in %) | | | |
|---|---|---|---|---|
| | Storage time (months) | | | |
| Formulation | 0 | 1 | 2 | 4 |
| A | 1.16 | 0.94 | 0.92 | 0.90 |
| reference A | 1.15 | 0.86 | 0.72 | 0.48 |
| B | 1.25 | 1.18 | 1.12 | 1.08 |
| reference B | 1.25 | 1.05 | 0.93 | 0.81 |

EXAMPLE 4

The effect of a surface-treatment of sodium dichloroisocyanurate for detergents stored at 30° C./85% relative moisture was examined. The samples are stored in board cartons treated with polyethylene. The chlorine content was determined by titration according to the iodine-thiosulphate method.

The following detergent composition was used in the tests:

| | |
|---|---|
| sodium tripolyphosphate | 45 parts |
| sodium metasilicate pentahydrate | 25 parts |
| sodium hydroxide | 15 parts |
| non-ionic surfactant | 2 parts |
| surface-treated sodium dichloroisocyanurate | 4 parts |
| soda | 9 parts |

A great many different substances were tested as surface-treating agents. The substances most useful in practice are indicated in Table 2.

The surface-treating agent was added by portions under vigorous agitation to the granulate chlorine compound. After finished addition agitation was continued for a further 2-3 minutes. Low viscous substances were hereby added at room temperature whereas high viscous substances as well as solid compounds were first heated to a suitable viscosity. The surface treating agent was added in an amount of 7%, calculated on the chlorine compound. A reference test was made, in which the surface treating agent was replaced by soda which is entirely inert in this connection.

The chlorine content of the different detergent compositions which thus differed only with regard to the surface-treatment of sodium dichloroisocyanurate, was determined as a function of the storage time.

The results of the tests are indicated in Table 4.

TABLE 4

| | Residual chlorine (in %) | | | |
|---|---|---|---|---|
| | Storage time (months) | | | |
| Surface-treating agent | 0 | 1 | 2 | 3 |
| Di-(2-ethyl-hexyl)phthalate | 2.30 | 1.88 | 1.85 | 1.80 |
| Di-(2-ethyl-hexyl)adipate | 2.27 | 1.84 | 1.80 | 1.77 |
| Reference test (soda) | 2.25 | 1.55 | 1.22 | 0.96 |

EXAMPLE 15

18.6 kg of granulate sodium dichloroisocyanurate were charged into a Lödiger mixer of 50 l. Under vigorous agitation 1.4 kg of di-(2-ethyl-hexyl)phthalate was added through a fine nozzle. The time of supply amounted to 3-5 minutes. After finished supply agitation was continued for a further few minutes, whereupon the mixer was emptied.

We claim:

1. A detergent composition comprising alkali metal phosphate, alkali metal silicate, a surfactant, a chlorinated triazine trione of the formula

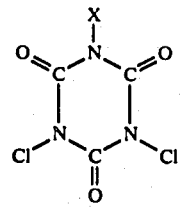

(I)

wherein X is Cl, Na or K, or when X is Na, the dihydrate thereof, and optionally conventional additives, characterized in that the chlorinated triazine trione of formula (I) is in the form of granules having a particle size of from 0.5 to 5 mm., said granules being coated with a hydrophobic layer consisting essentially of a thin layer of a diester selected from the group consisting of the diester of phthalic acid or adipinic acid with an alcohol having 4-18 carbon atoms, said diester being employed in an amount of 3-9% by weight, calculated on the amount of the chlorinated triazine trione of formula (I).

2. The composition of claim 1, characterized in that the alcohol is a straight or branched alcohol having 6-12 carbon atoms.

3. The composition of claim 1, characterized in that the hydrophobic layer comprises a diester selected from the group consisting of a fraction of diesters of phthalic acid and alcohols having 6-10 carbon atoms, di-(2-ethyl-hexyl) phthalate, diisodecylphthalate, di-(2-ethyl-hexyl) adipate and diisodecyl adipate.

4. The composition of one or more of claims 1-3, characterized in that for use as machine dish washing detergent the composition comprises 25-60% by weight of alkali metal phosphate
30-70% by weight of alkali metal silicate
0.5-3% by weight of surfactant
1-5% by weight of chlorinated triazine trione 3–9% by weight of diester, calculated on the amount of chlorinated triazine trione 0–40% by weight of conventional additives.

5. The composition of one or more of claims 1–4, characterized in that for use as an industrial detergent the composition comprises 25–60% of alkali metal phosphate 20–70% by weight of alkali metal silicate 0–30% by weight of alkali metal hydroxide 0.5–3% by weight of surfactant 1–10% by weight of chlorinated triazine trione 3–9% by weight of diester, calculated on the amount of chlorinated triazine trione 0–40% by weight of conventional additives.

6. An agent for producing a detergent composition, characterized in that the agent comprises granules of chlorinated triazine trione of the formula

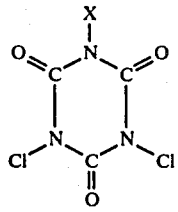

(I)

wherein X is Cl, Na or K, or the dihydrate of the triazine trione of formula (I) when X is Na, said granules having a particle size of from 0.5–5 mm., said granules being coated with a thin hydrophobic layer of a diester selected from the group consisting of the diester of phthalic acid or adipinic acid with an alcohol having 4–18 carbon atoms, said diester being employed in an amount of 3–9% by weight, calculated on the amount of the chlorinated triazine trione of formula (I).

7. The agent of claim 6, characterized in that the alcohol is a straight or branched alcohol having 6–12 carbon atoms.

8. The agent of claim 6, characterized in that the hydrophobic layer comprises a diester selected from the group consisting of a fraction of diesters of phthalic acid and alcohols having 6–10 carbon atoms, di-(2-ethyl hexyl) phthalate, diisodecylphthalate, di-(2-ethyl hexyl) adipate and diisodecyladipate.

* * * * *